United States Patent [19]

Clarke

[11] 3,999,748

[45] Dec. 28, 1976

[54] CHILDRENS GAME OF CATCH

[76] Inventor: William A. Clarke, 1001 Linden Ave., Erie, Pa. 16505

[22] Filed: Apr. 22, 1975

[21] Appl. No.: 570,509

[52] U.S. Cl. ..... 273/95 R; 2/19; 46/DIG. 1; 273/58 K

[51] Int. Cl.[2] ..... A63B 71/02

[58] Field of Search ..... 273/95 R, 96, 102 R, 273/26 E, 15, 58 R, 58 BA, 58, 106 R, 106 B, 106.5 R, 106.5 A, 58 A; 2/15, 18–20; 46/87–88, DIG. 1

[56] References Cited

UNITED STATES PATENTS

| | | | |
|---|---|---|---|
| 1,496,824 | 6/1924 | Nixon | 2/19 |
| 1,633,926 | 6/1927 | Craig | 2/19 |
| 2,783,046 | 2/1957 | Lien | 273/58 R |
| 3,032,345 | 5/1962 | Lemelson | 46/DIG. 1 |
| 3,141,173 | 7/1964 | Jackson | 2/19 |
| 3,391,933 | 7/1968 | Cooper | 46/DIG. 1 |
| 3,601,406 | 8/1971 | Guisti | 273/176 F |
| 3,721,447 | 3/1973 | Louderback | 273/186 E |
| 3,829,094 | 8/1974 | Goldfarb | 273/102 B |
| 3,953,030 | 4/1976 | Muchnick | 273/95 R |

*Primary Examiner*—Richard C. Pinkham
*Assistant Examiner*—Vance Y. Hum

[57] ABSTRACT

A game of catch for small children using a ball coated with burr material and a mitt or glove with outer faces of material to which the burr material adheres upon contact, a beginner can succeed in catching the ball almost from the start and acquires coordination later useful in baseball.

11 Claims, 8 Drawing Figures

CHILDRENS GAME OF CATCH

Figure 1:
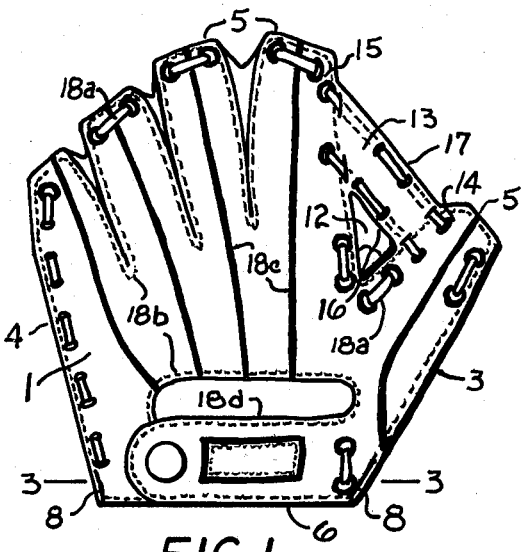

This invention is a game of catch for children which simulates baseball and offers comparable pleasure and at the same time teaches skills and coordination to children too young for baseball.

In the drawing

Figure 2:
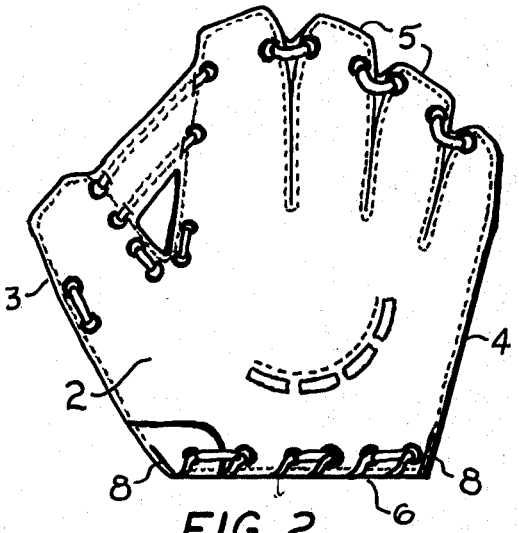
Figure 3:
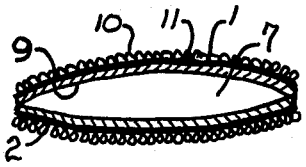
Figure 4:
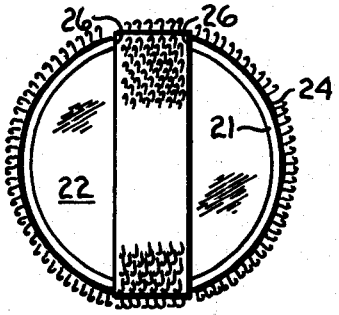
Figure 5:
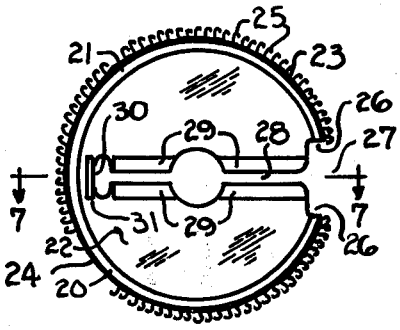
Figure 6:
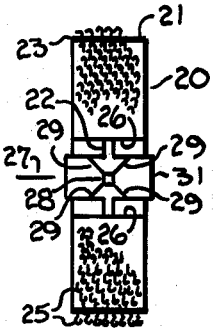
Figure 7:
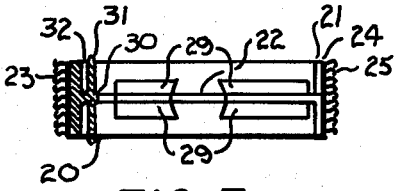
Figure 8:
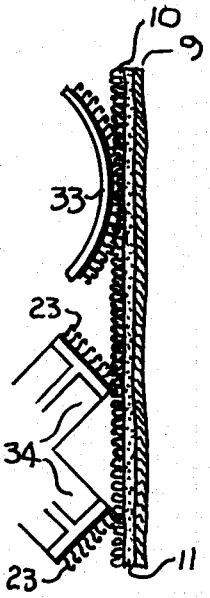

FIG. 1 is a top plan view of a hand covering worn on the catching hand of each player, FIG. 2 is a bottom plan, FIG. 3 is a section of line 3—3 of FIG. 1, FIG. 4 is an elevation of one of the balls used in the game, FIG. 5 is a plan view of one of the parts of the FIG. 4 ball, FIG. 6 is an edge view of the FIG. 5 part, FIG. 7 is a section of line 7—7 in FIG. 5 and FIG. 8 is a diagram of the modes of adherence of the ball to the mitt or hand covering.

The sheathlike covering which is worn upon the catching hand of each player resembles a baseball glove or mitt. It comprises two substantially identical symetrical pieces 1, 2 of textile material cut in the shape of a baseball glove or mitt. The pieces are placed back to back and peripherally sealed along thumb and little finger sides 3, 4 and at the finger tips 5 leaving at the wrist end 6 a wrist opening 7. Adhesives are preferred for the seals but other sealing means may be used. Adjacent to the wrist opening the seal may be reinforced by stitching 8. The material for the mitt comprises a flexible textile backing 9, a face or pile 10 of material to which a burr material will adhere upon contact and an intermediate layer 11 of flexible plastic foam sandwiched between and bonded or otherwise fixed to the layers 9 and 10. The burr adhering properties of the face 10 are derived from a multiplicity of loops and fibers which tangle with the hook shaped configuration of burr material. The textile material 9, 10, 11 is a commercially available material which is one form is a knit nylon loop pile face. The outer face 10 has a suedelike appearance and feel. The pieces 1, 2 have a cutout opening 12 providing a web 13 connecting the thumb and forefinger sections 14, 15 of the mitt. A peripheral seal 16 secures the edges of the material around openings. A continuation of the seal 5 joins the edges 17 of the web 13.

The parts so far described structurally define the mitt. When placed on the catching hand, th wearer's thumb is received in the section 14 bounded by the seals 3, 5 and 16 and the four fingers are received in a pocket bounded by the seals 4, 5 and 16. The feel is similar to a first baseman's mitt. Although individual sheath sections could be provided for each of the wearer's fingers, that is not necessary.

On the back of the mitt, the side visible in FIG. 1, lacing **18*a*, stitching 18*b*, seams 18*c* and a strap 18*d* are printed to give the appearance of a leather mitt. On the palm side of the mitt the side visible in FIG. 2,** similar stitching and lacing are printed to give the appearance of the palm side of the leather mitt. The ballpocket is also printed at the back of the palm. The mitt looks like a baseball mitt.

The mitt is adapted to low cost manufacture. The front and back pieces 1, 2 are of identical shape, although carrying different printing. The peripheral fastening of the two sheets is easily automated and can be done by high speed operation. In addition to adhesives, heat sealing, sewing and other textile joining processes may be used. Because of the symmetry of the parts 1, 2 the left hand glove shown in FIG. 1 and 2 may be worn on the right hand of a lefthanded player. The glove is always worn on the catching hand of the player leaving the other hand free for throwing.

The game is played with each player wearing on his catching hand a covering such as a glove or mitt with the exterior surfaces of a material to which the burr material adheres upon contact. The burr adherent face should be at least on the palm side of the mitt because that is the side which will usually be presented to the ball. However, for the player who manages to bring any outer surface of the mitt into contact with the ball it is desirable that the entire front and back surfaces of the mitt be of burr adherent material.

The players use the ball having its exterior surface coated with burr material. With this combination while playing catch, a player can literally catch any ball his mitt touches. No matter what part of the mitt contacts the ball the ball sticks and is caught. Young children who are just starting to play catch, are encouraged by the ease of catching and quickly develop skills and coordination which will later be useful in baseball.

The preferred ball for this game is disclosed in my application Ser. No. 528,675, incorporated by reference, filed Dec. 2, 1974, now U.S. Pat. No. 3,941,383. This ball is preferred because it is adapted to low cost mass production, has long life and a high degree of reliability.

The ball comprises two identical wheel elements 20, each with a cylindrical rim or felly 21 supported by a web or disc 22. The wheel elements are adapted to injection molded impact resistant thermoplastic such as high impact styrene, polyethylene, polypropylene, nylon, cryolac, etc. On the outer surface of the rim is fixed by adhesives or other suitable means a tread 23 of synthetic burr material such as a tape sold under the trademark "VELCRO". There is a large body of patent literature describing synthetic burr material. This tape is characterized by a backing 24 which is fixed to the outer surface of the rim 21 and a face or pile of hook-like spines 25 which simulate the properties of natural burr material. The tape is easily applied to the outer surface of the rim by automatic machinery which rolls onto the rim 21 tape with the backing 24 precoated with pressure sensitive adhesive. The rim 21 is interrupted (FIG. 5) providing circumferentially spaced ends 26 which are spaced apart a distance of slightly in excess of the axial width of the rim. Extending diametrically across the web or disc 22 in a plane 27 extending through the axis of the rim 21 midway between the ends 26 of the rim is a slot 28 having a width substantially equal to the thickness of the disc 22. On opposite sides of the slot are guideways 29 at an angle of substantially 45 degrees to the plane 27. The slot 28 is open at the ends 26 of the rim and has its other end 30 closed by a catch or detent element 31 having detent shoulders 32. When another part identical with that shown in FIG. 5 is rotated 180 degrees and turned into a plane at right angles to the plane 27 with the open ends of the slots 28 aligned and facing each other, pushing the parts together causes the catch 31, of each part to be snapped beneath the ends 26 of the other part. This results in a ball structure having external cylindrical surfaces of burr material which has the flight characteristics of a truly spherical ball.

When either tread 23 contacts the outer surface of the mitt, squarely, the adhesion is as illustrated at 33 in FIG. 8. When the treads contact the target in planes at an angle of 45 degrees to the surface of the mitt as shown at 34 in FIG. 8, the edge adhesion is ample and would be ample if only a single edge of the tread made contact with the burr adherent material of the mitt.

I claim:

1. A game of catch in which a ball is thrown back and forth between players, comprising a mitt or like hand covering for the catching hand of each player with at least the entire palm area and adjacent surfaces consisting of a layer of flexible textile material having an outer surface with a face of material to which burr adheres upon contact, said hand covering having a wrist opening, and a ball with exterior surfaces coated with burr material so the ball may be caught by a player who manages to bring any part of the palm and adjacent surfaces of his hand covering into contact with the ball.

2. A game of catch in which a ball is thrown back and forth between players, comprising a mitt or like hand covering for the catching hand of each player of flexible textile material having a face of material to which burr material adheres upon contact, said hand covering having a wrist opening, and a ball with exterior surface coated with burr material, the hand covering being made of two symetrical layers of said textile material peripherally joined together to define a hand receiving pocket and a wrist opening and with the material to which burr material adheres upon contact on both outer surfaces.

3. A game of catch in which a ball is thrown back and forth between players, comprising a mitt or like hand covering for the catching hand of each player of material to which burr material adheres upon contact, said hand covering having a wrist opening, and a ball with exterior surfaces coated with burr material, the ball being further defined as having two intersecting wheel elements at right angles to each other, each wheel element having a rim with a cylindrical outer surface coated with burr material, the axes of the cylindrical surfaces intersecting each other at right angles.

4. The game of claim 3 in which the wheel elements are of impact resistant thermoplastic.

5. A game of catch in which a ball is thrown back and forth between players, comprising a mitt or like hand covering for the catching hand of each player with at least the palm area and adjacent surfaces of material to which burr material adheres upon contact, said hand covering having a wrist opening, and a ball with exterior surfaces coated with burr material, the ball having two intersecting wheel elements at right angles to each other, each wheel element having a rim with a cylindrical outer surface coated with burr material, the axes of the cylindrical surface intersecting each other at right angles, and each wheel element having a one piece rim.

6. The game of claim 5 in which each wheel element is a disc wheel.

7. The game of claim 6 in which each rim has a slot extending inward from the outer periphery and receiving the other wheel element.

8. The game of claim 5 in which each wheel element is further defined as having a recess extending inward from its periphery, the recess in one wheel element extending in a direction opposite the direction in which the recess in the other wheel element extends.

9. The game of claim 8 in which the recesses have interengaging guide surfaces aligning the elements in planes at right angles to each other.

10. The game of claim 5 in which the wheel elements are of impact resistant thermoplastic having rims coated with a tape having a relatively non stretchable backing and a burr like pile.

11. The game of claim 5 further characterized by the ball having a first wheel element having a rim with a cylindrical outer surface coated with burr material, said first cylindrical outer surface being on the outer part of a disc, the cylindrical surface being interrupted and the disc being recessed inward opposite the interruption, the recess cooperating with the ends of the cylindrical surface at said interruption to form a first detent element, the disc having a slot extending diametrically inward from said recess and terminating in a second detent element on the inner surface of said cylindrical surface and complimentary to the first detent element and extending a right angle to said disc.

* * * * *